US007886830B2

(12) United States Patent
Bolding et al.

(10) Patent No.: US 7,886,830 B2
(45) **Date of Patent: *Feb. 15, 2011**

(54) DOWNHOLE SAFETY VALVE APPARATUS AND METHOD

(75) Inventors: Jeffrey L. Bolding, Kilgore, TX (US); David Randolph Smith, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/646,259

(22) Filed: Dec. 23, 2009

(65) Prior Publication Data

US 2010/0096145 A1 Apr. 22, 2010

Related U.S. Application Data

(63) Continuation of application No. 11/664,645, filed on Feb. 27, 2008, now Pat. No. 7,637,326.

(60) Provisional application No. 60/522,500, filed on Oct. 7, 2004.

(51) Int. Cl.
*E21B 34/10* (2006.01)

(52) U.S. Cl. ..... 166/375; 166/322; 166/386

(58) Field of Classification Search ..... 166/375, 166/322, 325, 386, 332.8
See application file for complete search history.

(56) References Cited

U.S. PATENT DOCUMENTS

| | | | | |
|---|---|---|---|---|
| 3,412,687 | A | 11/1968 | Moore, Jr. | |
| 3,848,669 | A * | 11/1974 | Brown | 166/72 |
| 4,367,794 | A | 1/1983 | Bednar et al. | |
| 4,434,847 | A * | 3/1984 | Vazquez et al. | 166/117.5 |
| 4,746,423 | A | 5/1988 | Moyer | |
| 5,803,173 | A | 9/1998 | Fraser, III et al. | |
| 7,637,326 | B2 * | 12/2009 | Bolding et al. | 166/375 |

* cited by examiner

*Primary Examiner*—Giovanna C Wright
(74) *Attorney, Agent, or Firm*—Zarian Midgley & Johnson PLLC

(57) ABSTRACT

The application discloses a safety valve to replace an existing safety valve in order to isolate a production zone from a string of tubing when closed. Preferably, the safety valve includes a flow interruption device displaced by an operating conduit extending from a surface location to the safety valve through the inside of the production tubing. The application also discloses a bypass-conduit which allows communication from a surface location to the production zone through the safety valve without affecting the operation of the safety valve.

22 Claims, 1 Drawing Sheet

DOWNHOLE SAFETY VALVE APPARATUS AND METHOD

CROSS REFERENCE TO RELATED APPLICATIONS

This application is a continuation of U.S. application Ser. No. 11/664,645 entitled "Downhole Safety Valve Apparatus and Method," filed on Feb. 27, 2008, now issued as U.S. Pat. No. 7,637,326, which claims the benefit of provisional application U.S. Ser. No. 60/522,500 filed Oct. 7, 2004 both of which are incorporated herein in their entireties by reference.

BACKGROUND

The present invention generally relates to subsurface safety valves. More particularly, the present invention relates to an apparatus and method to install a replacement safety valve to a location where a previously installed safety valve is desired to be replaced. More particularly still, the present invention relates to communicating with a production zone through a bypass-conduit when a replacement safety valve is closed.

Subsurface safety valves are typically installed in strings of tubing deployed to subterranean wellbores to prevent the escape of fluids from one production zone to another. Absent safety valves, sudden increases in downhole pressure can lead to catastrophic blowouts of production and other fluids into the atmosphere. For this reason, drilling and production regulations throughout the world require safety valves be in place within strings of production tubing before certain operations can be performed.

One popular type of safety valve is known as a flapper valve. Flapper valves typically include a flow interruption device generally in the form of a circular or curved disc that engages a corresponding valve seat to isolate one or more zones in the subsurface well. The flapper disc is preferably constructed such that the flow through the flapper valve seat is as unrestricted as possible. Usually, flapper-type safety valves are located within the production tubing and isolate one or more production zones from the atmosphere or upper portions of the wellbore or production tubing. Optimally, flapper valves function as large clearance check valves, in that they allow substantially unrestricted flow therethrough when opened and completely seal off flow in one direction when closed. Particularly, production tubing safety valves can prevent fluids from production zones from flowing up the production tubing when closed but still allow for the flow of fluids and/or tools into the production zone from above.

Flapper valve disks are often energized with a biasing member (spring, hydraulic cylinder, etc.) such that in a condition with zero flow and with no actuating force applied, the valve remains closed. In this closed position, any build-up of pressure from the production zone below will thrust the flapper disc against the valve seat and act to strengthen any seal therebetween. During use, flapper valves are opened by various methods to allow the free flow and travel of production fluids and tools therethrough. Flapper valves may be kept open through hydraulic, electrical, or mechanical energy during the production process.

Examples of subsurface safety valves can be found in U.S. Provisional Patent Application Ser. No. 60/522,360 filed Sep. 20, 2004 by Jeffrey Bolding entitled "Downhole Safety Apparatus and Method;" U.S. Provisional Patent Application Ser. No. 60/522,498 filed Oct. 7, 2004 by David R. Smith and Jeffrey Bolding entitled "Downhole Safety Valve Apparatus and Method;" U.S. Provisional Patent Application Ser. No. 60/522,499 filed Oct. 7, 2004 by David R. Smith and Jeffrey Bolding entitled "Downhole Safety Valve Interface Apparatus and Method;" all hereby incorporated herein by reference. Furthermore, applicant incorporates by reference U.S. Non-Provisional application Ser. No. 10/708,338 Filed Feb. 25, 2004, titled "Method and Apparatus to Complete a Well Having Tubing Inserted Through a Valve" and U.S. Provisional Application Ser. No. 60/319,972 Filed Feb. 25, 2003 titled "Method and Apparatus to Complete a Well Having Tubing Inserted Through a Valve."

Over time, a replacement subsurface safety valve may be desired. An existing subsurface safety valve can become stuck or otherwise inoperable either through failure of various safety valve components or because of caked-up hydrocarbon deposits, for example. In these circumstances, sudden increases in production zone pressure can lead to dangerous surface blowouts if the safety valves are not repaired. Because the repair or replacement of a subsurface safety valve formerly required the removal of the string of production tubing from the wellbore, these operations were frequently prohibitively costly for marginal wells. An improved apparatus and method to repair or replace existing subsurface safety valves would be highly desirable to those in the petroleum production industry.

SUMMARY

In one embodiment, a replacement safety valve to hydraulically isolate a lower zone below the replacement safety valve and an existing safety valve comprises a main body having a clearance passage through a longitudinal bore and an outer profile, the outer profile removably received within a landing profile of the existing safety valve, a flow interruption device located in the clearance passage pivotably operable between an open position and a closed hydraulically sealed position, and a bypass-conduit extending from a surface location through the replacement safety valve to the lower zone. The bypass-conduit may be wholly contained within a bore of a string of tubing carrying the existing safety valve.

In another embodiment, the bypass-conduit can be in communication with the surface location and the lower zone below the valve when the flow interruption device is in the closed hydraulically sealed position. The bypass-conduit can be in communication with the surface location and the lower zone below the valve when the flow interruption device is in the open position. The lower zone can be a production zone.

In yet another embodiment, the bypass-conduit passes through the existing safety valve en route to the lower zone. The main body can retain a second flow interruption device of the existing safety valve in an open position. The existing safety valve can include a first hydraulic conduit in communication with the replacement safety valve through a second hydraulic conduit therein. The existing safety valve can include a nipple profile.

In yet another embodiment, the replacement safety valve of claim can further comprise hydraulic seals hydraulically isolating the replacement safety valve from the existing safety valve. The bypass-conduit can extend through the main body of the replacement safety valve. The bypass-conduit can be a hydraulic fluid passage, a continuous string of tubing, or a hydraulic capillary tube. The hydraulic capillary tube can be a fluid injection hydraulic capillary tube. The fluid can be a foam or a gas. The fluid can be selected from the group comprising surfactant, acid, miscellar solution, corrosion inhibitor, scale inhibitor, hydrate inhibitor, and paraffin inhibitor.

In another embodiment, the bypass-conduit can be a logging conduit, a gas lift conduit, an electrical conductor, or an optical fiber. The bypass-conduit can further comprise a check valve below the replacement safety valve. The bypass conduit can further comprise a check valve between the replacement safety valve and a wellhead. The bypass-conduit can further comprise a hydrostatic valve between the replacement safety valve and a wellhead. The bypass-conduit can further comprise a hydrostatic valve below the replacement safety valve.

In another embodiment, the replacement safety valve further comprises an operating conduit in communication with-a source of an energy, the energy actuating the flow interruption device between the open position and the closed hydraulically sealed position. The operating conduit can extend from the surface location through the first bore of the existing safety valve to the main body. The operating conduit can extend from the surface location to the replacement safety valve through a wall of the existing safety valve.

In yet another embodiment, a method to hydraulically isolate a zone below an existing safety valve from a string of tubing carrying the existing safety valve in communication with a surface location comprises deploying a replacement safety valve through the string of tubing to a location of the existing safety valve, engaging the replacement safety valve within a landing profile of the existing safety valve, extending a bypass-conduit from the surface location, through the replacement safety valve, to the zone below the existing safety valve, and communicating between the surface location and the zone below the existing safety valve through the bypass-conduit. The replacement safety valve may be movable between an open position and a closed position. The method may further comprising communicating between the surface location and the zone below the existing safety valve when the flow interruption device of the replacement safety valve is in a closed hydraulically sealed position. The zone below the existing safety valve can be a production zone.

In another embodiment, a method can further comprise the step of communicating between the surface location and the zone below the existing safety valve through the bypass-conduit when the flow interruption device of the replacement safety valve is in an open position. A method can further comprise the step of retaining a second flow interruption device of the existing safety valve in an open position with an outer profile of the replacement safety valve. The bypass-conduit can be a hydraulic fluid passage, a continuous tube, or a hydraulic capillary tube. The bypass-conduit can comprise a plurality of a jointed pipe section deployed from the surface location. A method can further comprise the step of including a check valve in the bypass-conduit above the replacement safety valve or below the replacement safety valve.

In another embodiment, a method can further comprise the step of injecting a foam or a fluid to the zone below the existing safety valve through the bypass-conduit. The fluid can be selected from the group consisting of corrosion inhibitor, scale inhibitor, hydrate inhibitor, paraffin inhibitor, surfactant, acid, and miscellar solution. The bypass-conduit can be a logging conduit. The logging conduit can be greater than about one and a half inches in diameter. A method can include a bypass-conduit which can be a gas lift conduit, an electrical conductor, or an optical fiber.

In yet another embodiment, the method can further comprise the step of operating the flow interruption device between the closed hydraulically sealed position and an open position with an operating conduit. The method can further comprise the step of extending the operating conduit from the surface location to the replacement valve through the string of tubing. The method can further comprise the step of communicating hydraulic pressure through the operating conduit, through a first passage in the existing safety valve to a second passage in the replacement safety valve.

DETAILED DESCRIPTION

Figure 1:
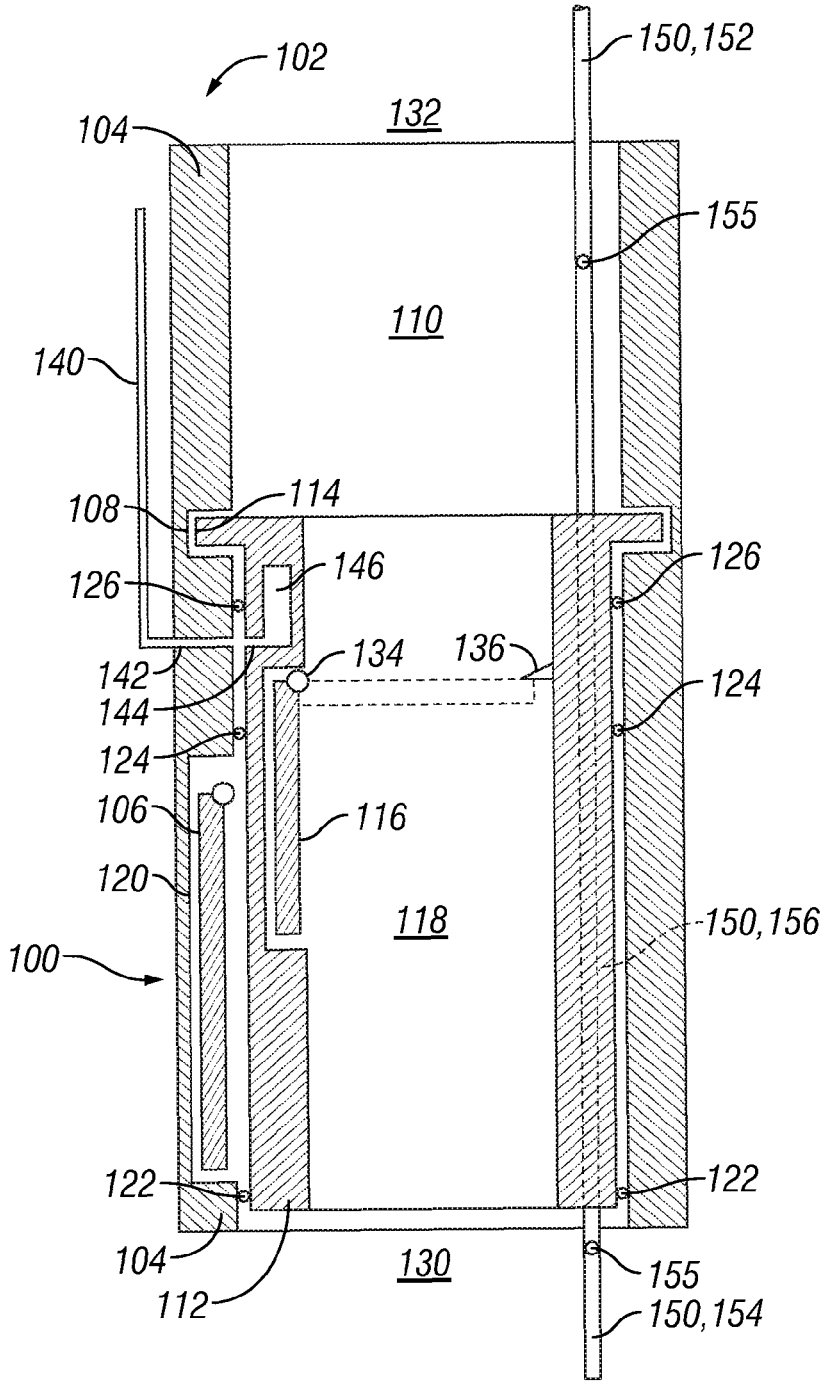
FIG. 1 is schematic representation of a replacement safety valve assembly installed in an existing safety valve in accordance with an embodiment of the present invention.

Referring initially to FIG. 1, a schematic representation of a replacement subsurface safety valve assembly 100 is shown engaged within an existing subsurface safety valve 102. Existing safety valve 102 includes a generally tubular valve body 104, a flapper 106, a landing profile 108, and a clearance bore 110. Likewise, replacement valve assembly 100 includes a main body 112, an engagement profile 114, a flapper 116, and a clearance bore 118.

With a replacement safety valve desired to be located within an existing safety valve 102, replacement valve assembly 100 is disposed downhole through the string of tubing or borehole where preexisting safety valve 102 resides. Once replacement valve 100 reaches existing safety valve 102, replacement valve 100 is actuated through clearance bore 110 until engagement profile 114 of replacement valve 100 engages and locks within landing profile 108 of existing safety valve 102. Landing and engagement profiles 108, 114 are shown schematically in FIG. 1 but any scheme for mounting a tubular or a valve downhole known to one of ordinary skill in the art may be used.

For example, to lock into place replacement subsurface safety valve assembly 100 within landing profile 108 of existing safety valve 102, engagement profile 114 can be constructed with a collapsible profile, a latching profile, or as an interference fit profile. In an interference-fit scheme (as shown schematically in FIG. 1), the outer diameter of engagement profile 114 is slightly larger than the diameter of the clearance bore 110 but slightly smaller than a minimum diameter of landing profile 108 of existing safety valve 102. Using this scheme, replacement valve 100 is engaged within clearance bore 110 until engagement profile 114 abuts valve body 104. Once so engaged, replacement valve 100 can be impact loaded until engagement profile 114 travels through clearance bore 110 and engages within landing profile 108. Alternatively, engagement profile 114 can be constructed to be retractable or extendable via wireline or hydraulic capillary such that the full dimension of engagement profile 114 is not reached until it is in position within landing profile 108.

Once installed, replacement valve body 112 opposes any biasing force remaining to retain flapper 106 of existing safety valve 102 out of the way within recess 120. Hydraulic seals 122, 124, and 126 isolate fluids flowing from production zones below valves 100, 102 through clearance bores 118, 110 from coming into contact with, and eroding components (106, 120) of existing safety valve 102 and the outer profile of replacement valve 100. Otherwise, paraffin and other deposits might clog the space defined between valve bodies 112 and 104 and could prevent subsequent repair or removal operations of either replacement valve 100 or existing safety valve 102.

In operation, fluids will flow from downhole zone 130, through clearance bore 118 of replacement valve 100, and through upper end of clearance bore 110 of existing safety valve 102 to upper zone 132. Typically, downhole zone 130 will be a production zone and upper zone 132 will be in communication with a surface station. Flapper 116 of replacement valve 100 pivots around axis 134 between an open position (shown) and a closed position (shown by dashed lines in FIG. 1). A valve seat 136 acts as a stop and seals a surface of flapper disc 116 to prevent hydraulic communication from lower zone 130 to upper zone 132 when flapper 116 is closed. With flapper 116 closed, increases in pressure in lower zone 130 act upon the bottom of and thrust flapper 116 against seat 136 with increased pressure to enhance any hydraulic seal therebetween. Typically, a torsional spring (not shown) acts about axis 134 to bias flapper disc 116 against seat 136 if not held open by some other means. Various schemes can be and have been employed to retain flapper 116 in an open position when passage from lower zone 130 to upper zone 132 is desired (or vice versa), including using a slidable operating mandrel or a hydraulic actuator housed within valve body 112. Regardless of how activated from open to closed position, flapper 116 acts to prevent communication from lower zone 130 to upper zone 132 when closed.

Additionally, replacement valve 100 can optionally be configured to have flapper 116 or any other component operated from the surface. An operating conduit (not shown) can optionally be deployed from a surface unit, through tubing and existing safety valve 102 to replacement valve 100 to operate flapper 116 from closed position to open position (or vice versa). Furthermore, referring again to FIG. 1, an existing operating conduit 140 emplaced with existing safety valve 102 can be used to operate flapper 116 of replacement valve 100. Specifically, operating conduit 140 extends from a surface location to existing safety valve 102 to operate flapper disc 106. While operating conduit 140 is shown schematically as a hydraulic conduit, it should be understood by one of ordinary skill in the art that any operating scheme including, electrical, mechanical, pneumatic, and fiber optic systems can be employed. A passage 142 connects operating conduit 140 to inner bore 110 of existing safety valve 102 to allow operating conduit 140 to communicate with replacement valve 100 through a corresponding passage 144. A pressure accumulator 146 is housed within main body 112 of replacement valve 100 and acts to store and convert pressure from operating conduit 140 into mechanical energy to displace flapper 116 between open and closed positions. Hydraulic seals 124, 126 ensure that any pressure in operating conduit 140 is maintained through passages 142, 144 and accumulator 146 with little or negligible loss. To prevent operating conduit 140 from communicating with bore 110 of existing safety valve 102 before replacement valve 100 is present, a rupture disc (not shown) can be placed within passage 142. Rupture disc can be configured to rupture at a pressure that is outside the normal operating range of existing safety valve 102. To install replacement valve 100, an operator increases pressure in operating conduit 140 to "blowout" rupture disc in passage 142 and then can install replacement valve 100. Once rupture disc is ruptured, operating conduit 140 can be used as normal to operate flapper 116 of replacement valve 100.

It is often desirable to communicate with lower zone 130 when flapper valve 116 is closed. For instance, there are circumstances where pressures within producing zones are such as to not allow the opening of flapper 116 but the injection of chemical, foam, gas, and other material to lower zone 130 is either beneficial or necessary. To accommodate such situations, a bypass-conduit 150 can be incorporated in replacement valve 100 such that communication between upper zone 132 and lower zone 130 can occur irrespective of the position of flapper 116. The upper zone 132 tan be a surface location. Bypass-conduit 150 includes an upper segment 152, a lower segment 154, and a passage 156 through replacement valve body 112 of replacement valve 100. Bypass-conduit 150 can be of any form known to one of ordinary skill in the art, but can be a single continuous hydraulic tube, a string of threaded tubing sections, an electrical conduit, a fiber-optic conduit, a gas lift conduit, or, depending of the size of replacement valve 100, a logging conduit. Typically, bypass-conduit 150 will most often be constructed as hydraulic capillary tubing allowing the injection of a chemical stimulant, surfactant, inhibitor, solvent, and foam from a surface location to lower zone 130.

Furthermore, if bypass-conduit 150 is constructed to allow the injection of fluid to lower zone 132 from above, a check valve 155 may be included to prevent increases in downhole pressure from blowing out past replacement valve 100 through bypass-conduit 150 to the surface. The term capillary tube is used to describe any small diameter tube and is not limited to a tube that holds liquid by capillary action nor is there any requirement for surface tension to elevate or depress the liquid in the tube. The term hydraulic and hydraulically are used to describe water or any other fluid and are not limited to a liquid or by liquid means, but can be a gas or any mixture thereof.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A replacement safety valve to hydraulically isolate a lower zone below said replacement safety valve and an existing safety valve, the replacement safety valve comprising:

a main body having a clearance passage through a longitudinal bore and an outer profile, said outer profile removably received within a landing profile of the existing safety valve;

a flow interruption device located in the clearance passage pivotably operable between an open position and a closed hydraulically sealed position; and a bypass-conduit extending from a surface location through the replacement safety valve to the lower zone.

2. The replacement safety valve of claim 1 the outer profile further comprising an engagement profile, wherein the engagement profile is configured to engage the landing profile.

3. The replacement safety valve of claim 1 wherein said bypass-conduit is in communication with the surface location and the lower zone below said valve when said flow interruption device is in said closed hydraulically sealed position.

4. The replacement safety valve of claim 1 wherein said bypass-conduit is in communication with the surface location and the lower zone below said valve when said flow interruption device is in said open position.

5. The replacement safety valve of claim 1 wherein said bypass-conduit is wholly contained within a bore of production tubing.

6. The replacement safety valve of claim 1 wherein said existing safety valve includes a first hydraulic conduit in communication with said replacement safety valve through a second hydraulic conduit therein.

7. The replacement safety valve of claim 1 wherein said bypass-conduit is a hydraulic fluid passage, a continuous string of tubing, a hydraulic capillary tube, fluid injection hydraulic capillary tube, a logging conduit, a gas lift conduit, an electrical conductor, or an optical fiber.

8. The replacement safety valve of claim 1 wherein the bypass-conduit further comprises a check valve or a hydrostatic valve.

9. The replacement safety valve of claim 1 further comprising an operating conduit, wherein the operating conduit actuates the flow interruption device between said open position and said closed hydraulically sealed position.

10. The replacement safety valve of claim 1 wherein said bypass-conduit is configured to inject a substance from the bypass-conduit into the zone below the existing safety valve.

11. A method to hydraulically isolate a zone below an existing safety valve from a string of tubing carrying said existing safety valve in communication with a surface location, the method comprising:

deploying a replacement safety valve through the string of tubing to a location of the existing safety valve;

engaging the replacement safety valve within a landing profile of the existing safety valve;

extending a bypass-conduit from the surface location, through the replacement safety valve, to the zone below the existing safety valve; and communicating between the surface location and the zone below the existing safety valve through the bypass conduit.

12. The method of claim 11 wherein the zone below the existing safety valve is a production zone.

13. The method of claim 11 wherein the replacement safety valve is movable between an open position and a closed position.

14. The method of claim 13 further comprising the step of communicating between the surface location and the zone below the existing safety valve through the bypass-conduit when the flow interruption device of the replacement safety valve is in a closed position.

15. The method of claim 11 wherein said bypass-conduit is a hydraulic fluid passage, a continuous tube, a hydraulic capillary tube, a plurality of jointed pipe sections deployed from the surface location, a logging conduit, a gas lift conduit, an electrical conductor, or an optical fiber.

16. The method of claim 11 further comprising the step of injecting a foam to the zone below the existing safety valve through the bypass-conduit.

17. The method of claim 16 wherein the foam is injected to the zone below the existing safety valve through the bypass-conduit when the replacement safety valve is in a closed position.

18. The method of claim 11 further comprising the step of injecting a fluid to the zone below the existing safety valve through the bypass-conduit.

19. The method of claim 18 wherein fluid is injected to the zone below the existing safety valve through the bypass-conduit when the replacement safety valve is in a closed position.

20. The method of claim 18 wherein the fluid is selected from the group consisting of corrosion inhibitor, scale inhibitor, hydrate inhibitor, paraffin inhibitor, surfactant, acid, and miscellar solution.

21. The method of claim 11 further comprising the step of operating the flow interruption device between the closed hydraulically sealed position and an open position with an operating conduit.

22. The method of claim 11 further comprising the step of injecting a substance from the bypass-conduit into the lower zone below the existing safety valve.

* * * * *